US006101780A

United States Patent [19]

Kreidt

[11] Patent Number: 6,101,780

[45] Date of Patent: Aug. 15, 2000

[54] BUILDING CONSTRUCTION DEVICE AND PROCESS

[76] Inventor: William Kreidt, 31 Buxton La., Boynton Beach, Fla. 33462

[21] Appl. No.: 09/020,623

[22] Filed: Feb. 9, 1998

[51] Int. Cl.[7] ..... E04B 1/24

[52] U.S. Cl. ..... 52/712; 52/715; 52/489.2; 52/181.1; 52/281

[58] Field of Search ..... 52/712, 715, 489.1, 52/489.2, 481.1, 281

[56] References Cited

U.S. PATENT DOCUMENTS

| | | | |
|---|---|---|---|
| 523,359 | 7/1894 | Leicht . | |
| 1,146,251 | 7/1915 | Harp | 52/715 |
| 1,619,947 | 3/1927 | Makowski . | |
| 1,737,100 | 11/1929 | Thurman et al. . | |
| 2,120,709 | 6/1938 | McKay | 52/281 |
| 2,855,640 | 10/1958 | Rolen . | |
| 2,903,753 | 9/1959 | Nelsson | 52/715 |
| 3,020,602 | 2/1962 | Siering | 20/4 |
| 3,256,030 | 6/1966 | Banse | 52/712 |
| 3,365,222 | 1/1968 | Polyak | 287/20.94 |
| 3,420,019 | 1/1969 | Padilla | 52/715 |
| 3,440,791 | 4/1969 | Troutner . | |
| 3,500,604 | 3/1970 | Vandall . | |
| 3,603,197 | 9/1971 | Wood | 85/13 |
| 3,889,441 | 6/1975 | Tiedown | 52/715 |
| 3,910,001 | 10/1975 | Jackson | 52/281 |
| 4,246,736 | 1/1981 | Kovar | 52/696 |
| 4,318,261 | 3/1982 | Smith . | |
| 4,330,971 | 5/1982 | Auberger | 52/210 |
| 4,498,801 | 2/1985 | Gilb | 403/232.1 |
| 4,517,776 | 5/1985 | Barker | 52/90 |
| 4,527,375 | 7/1985 | Braginetz | 52/712 |
| 4,890,436 | 1/1990 | Colonias | 52/643 |
| 4,932,173 | 6/1990 | Commins | 52/92 |
| 4,946,123 | 8/1990 | Albert . | |
| 5,230,198 | 7/1993 | Callies | 52/702 |
| 5,325,651 | 7/1994 | Meyer et al. | 52/715 |
| 5,351,457 | 10/1994 | Colen | 52/438 |
| 5,390,460 | 2/1995 | Llorens . | |
| 5,403,110 | 4/1995 | Sammann | 403/234 |
| 5,423,156 | 6/1995 | Nellessen, Jr. . | |
| 5,437,132 | 8/1995 | Meyers | 52/410 |
| 5,457,928 | 10/1995 | Sahnazarian | 52/702 |
| 5,528,875 | 6/1996 | Ziegler, Jr. et al. | 52/702 |
| 5,560,156 | 10/1996 | McDonald | 52/92.2 |
| 5,640,822 | 6/1997 | Haswell | 52/712 |

OTHER PUBLICATIONS

Catalog C–HW95, Simpson Strong Tie Company, Inc., pp. 4–21 (1995).

Catalog C–HW95, Simpson Strong Tie Company, Inc., pp. 4–21 (1995).

*Primary Examiner*—Carl D. Friedman
*Assistant Examiner*—Phi Dieu Tran A
*Attorney, Agent, or Firm*—Quarles & Brady LLP

[57] ABSTRACT

A system for preventing damage to a building or other structure during severe meteorological conditions (high wind) or geological (seismic) activity. The system includes a tiedown bracket for securing a roof or wall panel to an underlying support member, e.g., a truss or joist, and a stud connector for attaching the stud perpendicularly to its support beam. The bracket enwraps three sides of the support member and is gusseted on each side of the support member. The gussets have extension portions which extend through joints between the roof or wall panels and then are bent over to hold down the panels so they bear on the support member. The stud connector engages three sides of a stud support beam and four sides of the stud. The bracket and connector can have particular anchors integral with the plates forming them such that conventional fastening means, e.g., nailing, can be reduced or eliminated. Another embodiment of the bracket is designed for application to a support member which is abutted by a cross-piece, e.g., a subfacia board. Methods of use are also described.

7 Claims, 12 Drawing Sheets

BUILDING CONSTRUCTION DEVICE AND PROCESS

FIELD OF USE

The invention pertains to a system for preventing damage to a building during high winds or seismic activity, and more specifically to roof sheathing, wall panel, and stud connectors and methods of using those connectors for connecting roof sheathing, wall panels, and studs in a building structure.

BACKGROUND OF THE INVENTION

Roof and wall panels are typically attached to supports or studs by nailing through the panels directly into the support. However, such means of attachment can be insufficient to secure the panels in conditions of high winds, e.g., a tornado, hurricane, or during an occurrence of seismic activity. These extreme meteorologic or geological conditions can result in damage to a building which would be prevented by a more secure fastening of the roof or wall panels to its underlying support.

Various brackets and fasteners have been developed to address the separation of panels from a supporting member under the stress of certain conditions such as high winds. For example, U.S. Pat. No. 5,437,132 to Meyers describes a generally J-shaped bracket which fastens a roof or wall panel to its underlying support truss or wall stud. The bracket has an elongated main body which extends along one side of the width of the support, and two flat plates which are folded in opposite directions to meet the outside face of each of two roof or wall panels.

U.S. Pat. No. 4,318,261 to Smith also describes a generally J-shaped clip for securing a roof panel to a support member or joist. The Smith '261 patent describes a clip having a lower leg for connection to a joist, a shank for extending upwardly along one side of a joist, and between two adjacent roof or wall panels, wherein the shank forms two upper legs which can be folded in opposite directions and over adjacent panels to hold them down.

Similarly, U.S. Pat. No. 3,500,604 to Vandall describes a tiedown clip having two flaps extending from a shank which are folded over in opposite directions to adjacent wall or roof panels. The shank of the tiedown clip in the '604 patent includes a notched recess which receives the edge of a support member.

Nellessen, Jr., U.S. Pat. No. 5,423,156, describes a strap for installation over sheathing to hold the sheathing to an underlying support structural frame member through use of interconnecting bands and a saddle. The strap described in the '156 patent extends across the entire width of the sheathing and requires the use of a pair of saddle members and connecting bands which are received by the strap and the saddle members.

U.S. Pat. No. 5,390,460 also describes a strapping means for securing a roof panel to a support beam wherein the strapping means extends across the entire width of the roof panel. One end of the strapping means forms a J-shaped hook which conforms to the shape of the beam and is secured thereto by nailing.

A clip for locating and maintaining co-planar adjacent non-interfitting edges of panels is described by Roland in U.S. Pat. No. 2,855,640. The clip is formed by a vertically disposed body which extends perpendicularly to the plane of the floor panels it is designed to maintain co-planar. The body extends into a pair of tabs which extend laterally in both directions over a floor panel to prevent buckling of the panels at the joint.

Wall fasteners having flaps or wings which extend in opposite directions on the outside of the wall are described in U.S. Pat. Nos. 523,359, 1,619,947, and 1,737,100. These flaps, however, do not connect to a member which enwraps a support member behind the wall.

U.S. Pat. Nos. 3,440,791 and 4,527,375 describe strapping brackets for floor decking. The '791 patent describes a bracket which is fitted around three sides of the support member under the floor decking and extends through slots made in the decking to form a pair of flaps which are folded inwardly, in a manner to overlap each other, and secured together. The strap of the '375 patent extends across the width of the deck board and extends along the sides, but does not enwrap the support member underlying the deck board.

Thus, there is a need in the building construction industry for a connector system which can prevent dislodgment of roof or wall panels and wall studs from their support members during extreme wind conditions or during seismic activity.

BRIEF SUMMARY OF THE INVENTION

This invention concerns a system for preventing damage to a building during conditions of high wind or seismic activity. The system of the subject invention includes a roof or wall panel tiedown bracket for securing the panel to an underlying support member and a stud connector to anchor a stud perpendicular to its supporting frame member. The subject invention further includes a method for constructing a building roof or wall using the subject system and the novel brackets or connectors.

The novel roof or wall panel tiedown bracket of the subject system comprises connected plates and a method of securing roof or wall panels wherein one surface of the panel is positioned against a supporting truss, rafter or stud. The tiedown bracket preferably comprises a single sheet of a rigid but bendable material, e.g., sheet metal, patterned such that the sheet can be bent along particular bend lines to form an operational bracket. The bracket comprises a main body plate which in use, in a preferred embodiment, is generally a squared U-shape.

Attached to a front or back edge of each of the upwardly bent sides of the U-shaped main body plate is a generally triangular plate forming a gusset. In operation, the gusset plates are bent at right angles to the main body plates to align with a juncture of an overlaying roof or wall panel.

At the top edge of the gusset plates are a plurality of securing plates of a length such that they extend through adjacent wall or roof panels, or a gap therebetween the roof or wall panel, and past the outer face of the roof or wall panels. The securing plates can be folded over at bend lines along the juncture of the securing plates and gusset plate such that the securing plates can be bent down to meet the outer face of the roof or wall panel for securing thereto.

In a preferred embodiment, the bracket of the subject invention comprises angular cut-out sections, forming anchors which have a pointed end and which serve as a means for anchoring the bracket to the underlying support members or to the panels. These anchors can completely replace the use of nails or other like fastening means, if the user so desires. Additional fastening means, e.g., nails, bolts, screws, staples, tacks, brads, rivets, or the like, can also be used. When the bracket is properly positioned, the securing plates, which can also comprise anchors as described herein, are attached against the outer surface of the panels and the main body enwraps or engages at least three sides of the roof or wall panel support member or truss.

The stud connector which is included as part of the system of the subject invention comprises a rigid but bendable band which enwraps three sides of a support beam and extends along a portion of the stud. Integral with the portion of the band extending along the sides of the stud are plates which can be bent or formed perpendicular to the band to engage the other two sides of the stud. The stud connector is useful for anchoring wooden studs in wood-frame construction systems. Thus, in a preferred system, the stud connector is used at the top and bottom of studs, especially in the construction of walls which support the roof structure. For additional connection strength in resisting upward forces, the stud connector can be anchored, e.g., bolted, to the foundation of the building.

It is therefore an object of this invention to provide a system for preventing damage to a building during high winds caused by a tornado, hurricane, or wind storm, or during seismic activity.

It is another object of the subject invention to provide a roof or wall panel tiedown bracket for positively connecting roof or wall panels to their respective supporting trusses, rafters, joists, beams, and studs. The terms "trusses," "rafters," "joists," "beams," and "studs" are collectively referred to herein as "supports", "support beams", or "support members".

It is yet another object of this invention to provide a tiedown bracket for significantly enhancing over conventional nailing the resistivity to upward and outward detachment of roof and wall panels from their supports in extreme wind conditions or during seismic activity.

It is yet another object of this invention to provide an economical and easily manufacturable sheet metal tiedown bracket which can facilitate installation. The subject tiedown bracket significantly increases the strength of attachment of roof panels or wall panels to their respective supporting roof rafters or studs over conventional nailing attachment.

A further object of the invention is to provide a stud connector for connecting a stud to its perpendicular support beam wherein the stud connector can prevent dislodgment of the stud from the support beam under high stress conditions.

It is still a further object of the invention to provide a stud connector for significantly enhancing the resistivity to upward and outward forces which can dislodge a stud from its support beam in extreme wind conditions or seismic activity.

It is another object of the invention to provide an economical and easily manufacturable stud connector which significantly increases the strength of attachment of a stud to its underlying support, e.g., a support beam or building foundation, over conventional nailing attachment.

The subject invention can advantageously eliminate the need for the use of nails in securing a roof or wall panel or stud to its corresponding support. More specifically, the subject invention includes anchor means whereby the connectors of the system can be affixed to a wall or roof panel, or a stud, and their corresponding support members without the use of nails for securing the panel or stud to said support member. The elimination of nails or other like attachment or fastening means can reduce the time and expense associated with conventional securing means, as well as reduce the weight which is added by such securing means.

In accordance with these and other objects which will become apparent hereinafter, the instant invention will now be described with reference to the accompanying drawings.

DETAILED DESCRIPTION OF THE INVENTION

The subject invention concerns a system for preventing damage to a building, particularly in high wind conditions or during seismic activity. The subject system comprises brackets or connectors and methods for securing roof or wall panels to underlying support members, and for securing studs to their support beams, in a manner which strengthens the structure by resisting upward and outward forces that can be applied to a structure during such high wind conditions or seismic activity. Specifically, the system comprises a novel, one-piece wall or roof panel tiedown bracket having a main body plate which engages three sides of a stud or roof joist. Co-extensive with the main body plate are a pair of gussets connecting the main body plate to securing plates which extend past the outer face of the panel and which can be bent over and parallel to the outer face of the panel so that the panel is securely held down relative to the support member.

The system further comprises a novel stud connector for securing a stud perpendicularly to a stud support beam. The stud connector comprises a band which engages three sides of the beam and extends to engage two opposite sides of the stud. Co-extensive with the portion of the band engaging the stud are plates which can be bent such that the plates engage the remaining exposed sides of the stud.

The method of the subject invention further comprises installing the novel brackets or connectors in the appropriate locations during construction of a building. For example, to prevent dislodgement of roof or wall panels in extreme conditions, the tiedown brackets can be used such that each roof or wall panel is secured to its underlying support member by at least one of the subject brackets. Preferably, a tiedown bracket of the subject invention is used at least at each of the four corners of the wall or roof panel. More or fewer tiedown brackets can be used as desired for providing additional structural strength.

The stud connectors can be used for each stud, at the top and bottom of the stud, for maximum structural strength. For economic and convenience purposes, however, it may be possible to use fewer connectors and still provide adequate structural strength to withstand high winds or seismic activity.

Appropriate numbers and locations for placement or installation of the brackets or connectors of the subject system can be determined according to conventional and standard engineering principles, and would be well within the purview of those of ordinary skill in the building construction and engineering arts.

Figure 1:
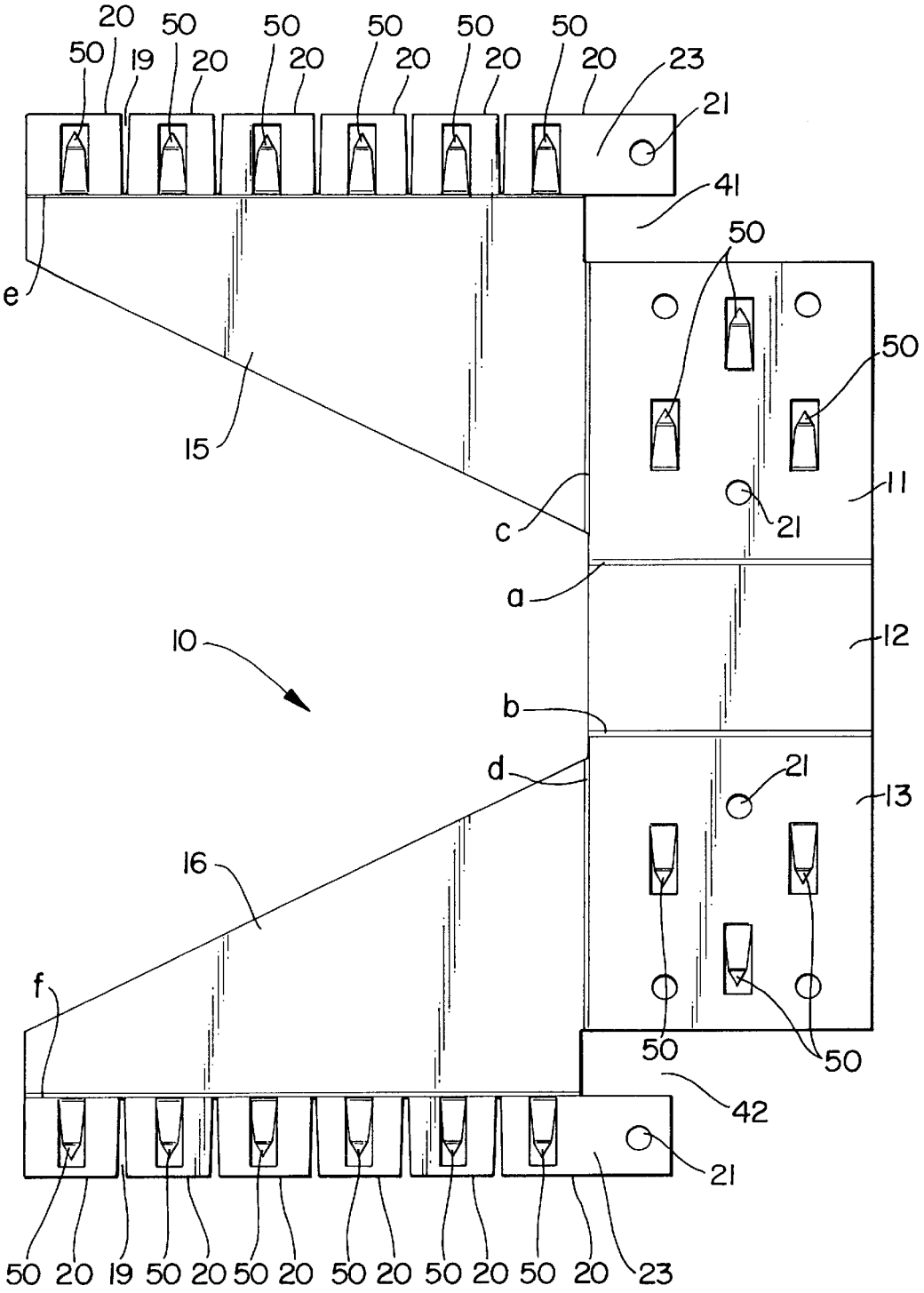
FIG. 1 shows, in the flat configuration, a top plan view of an embodiment of a bracket according to the subject invention which is used for affixing a roof or wall panel to a support member.

Referring now to the drawings, a preferred embodiment of a roof or wall panel tiedown bracket according to the subject invention is shown in the flat configuration as numeral 10 in FIG. 1. This tiedown bracket 10 can preferably be formed of sheet metal material. Other materials can also be used so long as they are rigid enough and of sufficient strength to function in a manner and for the purpose described herein, and can be bent or provided with bend areas, e.g., bend lines or otherwise formed to conform to particular shapes. Bend lines refer to a linear area between two coextensive plates which serve as a guide for and to facilitate bending of the sheet metal or other material into a desired configuration. Bend lines can be pre-formed as scored or weakened areas in the material to facilitate bending thereof. Such materials would be readily recognized by persons of ordinary skill in the art.

The tiedown bracket 10 includes a main body comprising two main body plates 11 and 13, respectively, and a connecting plate 12, therebetween. The main body plates 11 and 13 are connected to the connecting plate 12 at bend lines a and b. The connecting plate 12 is generally of a length approximately equal to the shortest dimension of a support member (not shown), such as a truss or stud, so that the inner faces of the main body plates 11 and 13 and the connecting plate 12 fit against the corresponding side of said support member.

Figure 2:
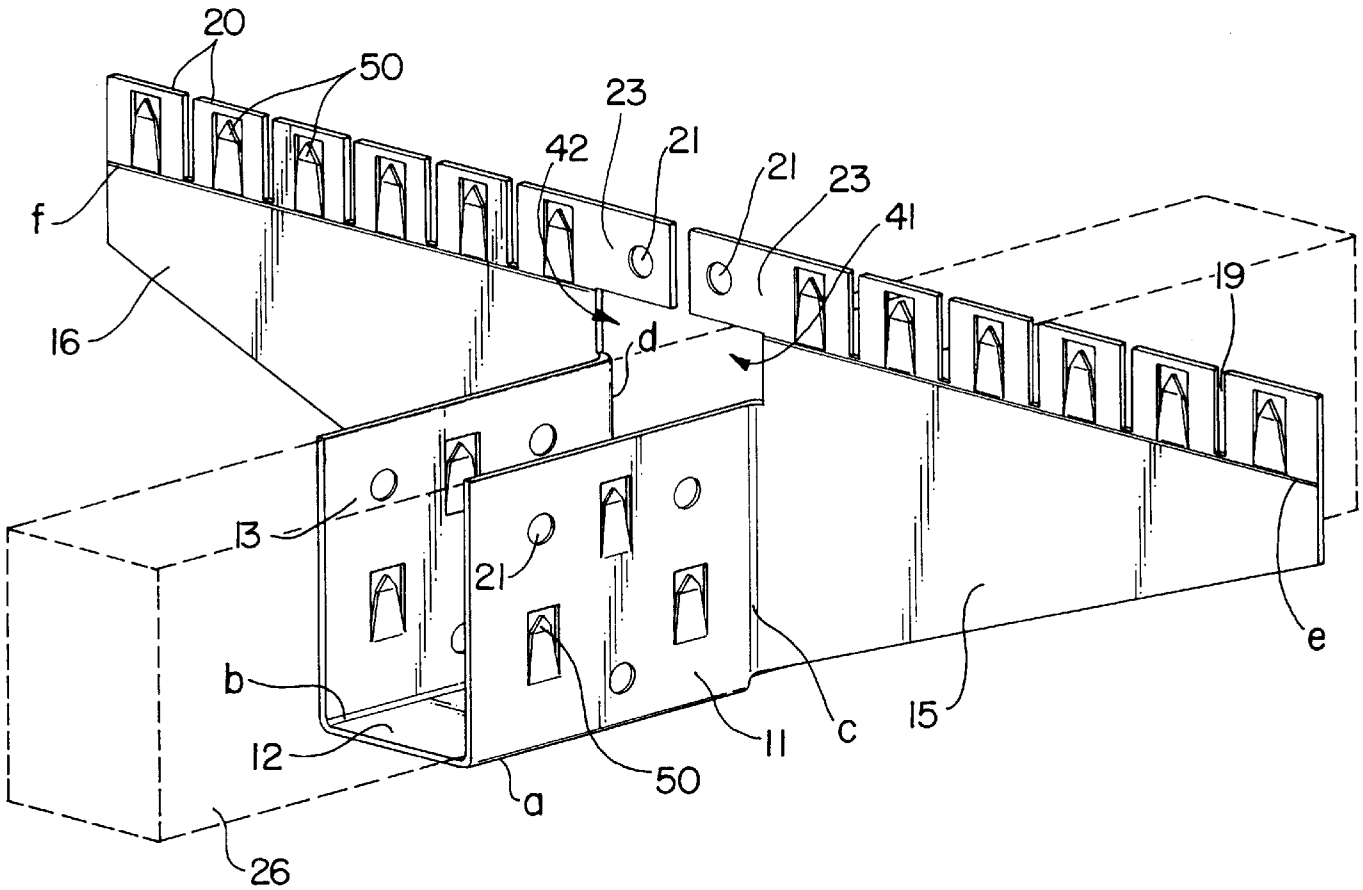
FIG. 2 shows a perspective view of the embodiment of the bracket shown in FIG. 1 in a configuration to engage a support member, which is shown in phantom.

The length of main body plates 11 and 13 are generally equal to a width of a side of the support rafter or stud on which the bracket will be used and, when in operational use, are positioned directly against the surface of the support (See FIG. 2).

Further referring to FIG. 1, connected along the outer edge of each main body plate 11 and 13, along bend lines c and d, are gussets, 15 and 16, respectively. The gusset plates 15 and 16 can be attached at a front or back edge of the main body plates 11 and 13, respectively. Preferably, each gusset 15 and 16 is connected to the same corresponding edge of its main body plate 11 and 13, i.e., both are either attached at the back edge or both are attached at the front edge of the main body plates 11 and 13.

Figure 2A:
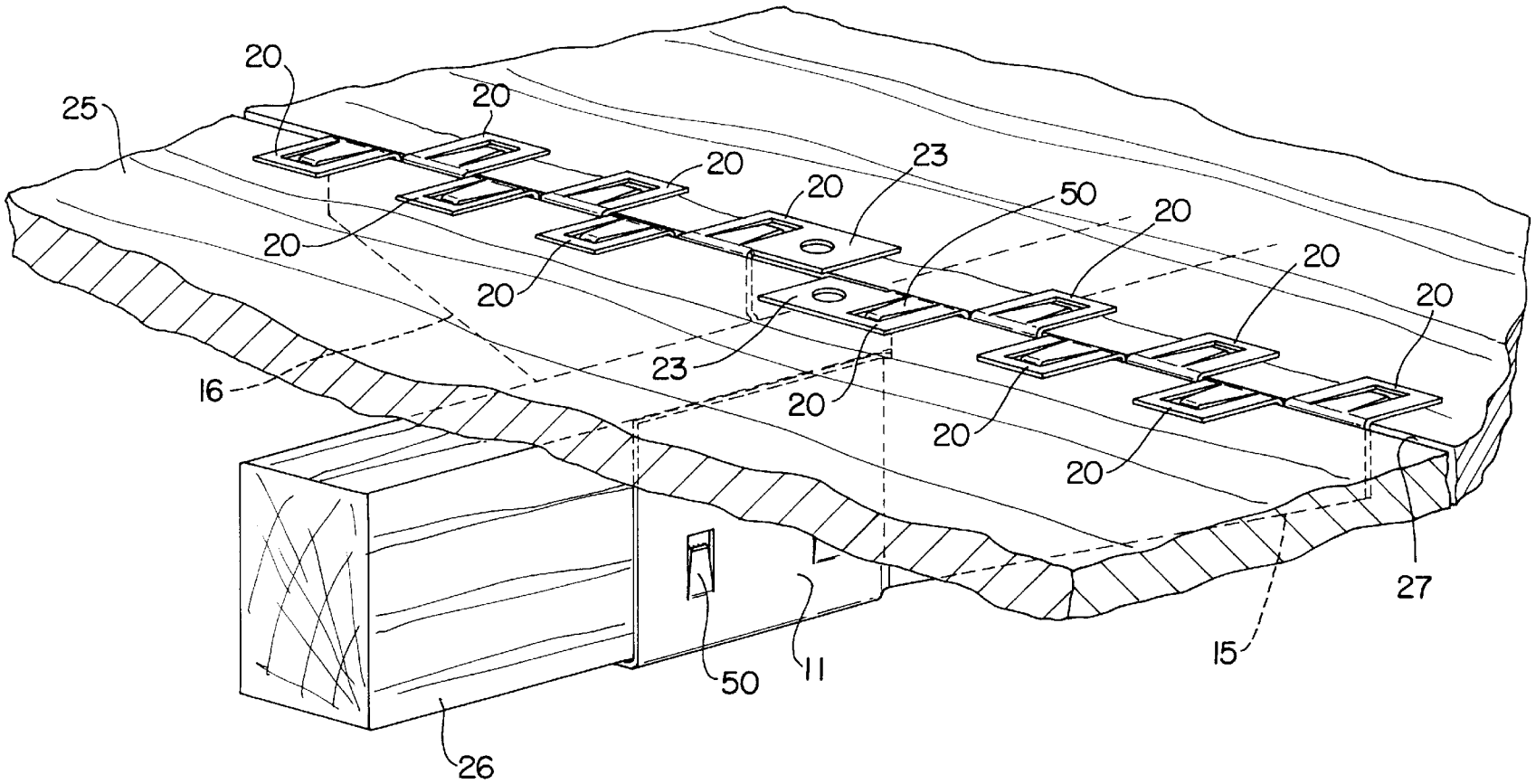
FIG. 2A shows, in optional use, a perspective view of the embodiment of the bracket shown in FIG. 1.

As shown in FIGS. 2 and 2A, when the subject bracket is bent at bend lines c and d, the gussets 15 and 16 are at right angles to both the main body plates 11 and 13 and the support member. The gusset plates 15 and 16 are bordered at their top edge by bend lines e and f, extending beyond the top edge of the main body plates 11 and 13 approximately a distance equal to the width of a roof or wall panel. Extending from the top of the gusset plates 15 and 16, along bend lines e and f, respectively, are securing plates 20 which can be folded over the outer face of the roof or wall panel 25 to secure the roof or wall panel against the support member 26 (FIG. 2A). In one embodiment, the securing plates 20 can comprise at least one slit 19 substantially perpendicular to the bend lines e and f. The slit 19 extends from the outer edge of the securing plate 20, up to but not intersecting bend lines e and f, forming a plurality of adjacent sections or tabs for securing the roof or wall panels. The slit 19 permits the roof panel securing plates 20 to be folded to contact and thereby to secure the roof or wall panels in place. In a preferred use, adjacent securing plates 20 are bent in opposite directions coplanar with each other over the roof or wall panels. In one embodiment, shown in FIGS. 1, 2, and 2A, a portion of the innermost securing plates 20 can extend beyond the length of the gusset plate defined by bend line f, forming a securing plate extensions 23 and rectangular notches 41 and 42 which can facilitate fitting of the bracket 10 to the truss and overlying panels by providing an area for apertures 21, e.g., nail holes, for receiving affixing means, e.g., nails, screws, bolts, tacks, or the like, for affixing the bracket to the top side of the truss, which lies directly beneath said securing plate extensions 23.

In use, the sheet metal pattern shown in the flat configuration in FIG. 1 for fabricating the tiedown bracket is generally folded at fold lines a and b to engage a support rafter or stud. Thereafter, folds or bends are made at bend lines c, d, e, and f, such that gusset plates 16 and 17 extend perpendicular to the main body plates 11 and 13 and the support member 26 (FIGS. 2 and 2A), and parallel to a joint 27 between abutting roof or wall panels 25 (FIG. 2A). As shown in FIG. 2, securing plates 20 extend above the roof or wall panel in this conformation. Bends are made along bend lines e and f so that adjacent securing plates 20 are parallel to and contacting the roof or wall panel 25 (FIG. 2A). Preferably, adjacent securing pates 20 are bent in opposite directions from one another in coplanar fashion (FIG. 2A). The specific order and sequence of these bends may be varied depending upon adaptation to a particular installation process.

The preferred embodiment of the bracket is shown in various stages of its operational positions in FIGS. 2 and 2A. Specifically, FIG. 2 shows the subject bracket in a bended configuration to engage and connect to the support member 26, but prior to placement of the wall or roof panel and bending securing plates 20 thereover. FIG. 2A shows the bracket as configured after placement of the roof or wall panels, securing of the panels by securing plates 20 and 20', and anchoring by anchoring means 50.

In constructing a roof or wall, the support rafters or studs are significantly longer than the width of each of the panels which are positioned abutting one another to form a continuous roof or wall surface. Thus, a plurality of roof or wall panels are required to completely cover and form the continuous roof and wall surface. Typically then, roof or wall panels are positioned and supported on an edge surface of a support member and abutted against one another along a joint line. The panels are typically nailed directly therethrough into the support rafter or stud. In a preferred embodiment of the subject invention, the use of nails to secure a roof or wall panel in position can be eliminated by use of anchors, as described herein, to secure the tiedown bracket to the support member and to said roof or wall panel.

Figure 3:
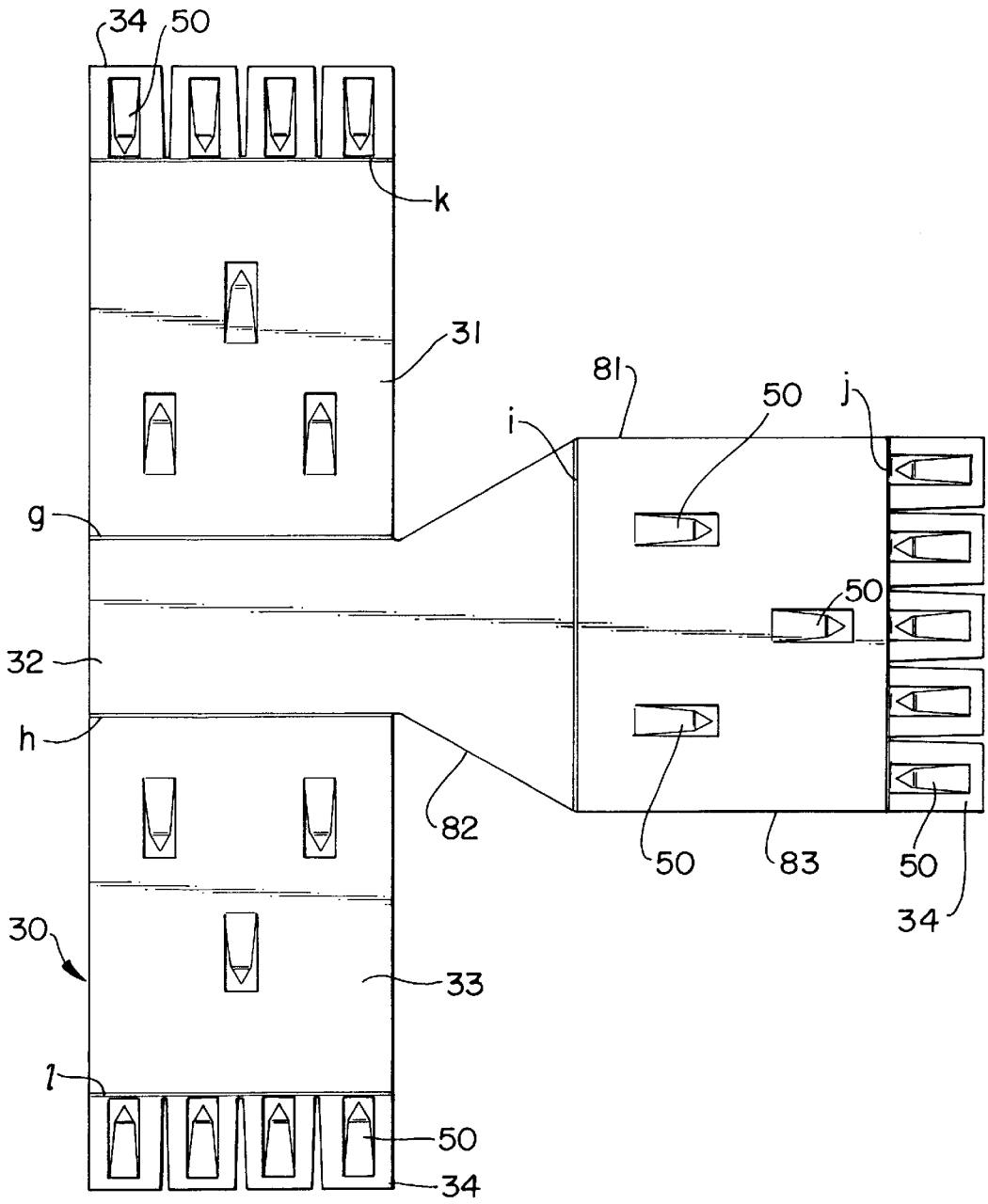
FIG. 3 shows, in the flat configuration, a top plan view of an embodiment of a bracket according to the subject invention used for affixing together a support member, a cross-piece perpendicular to said support member, and a roof or wall panel overlying said support member and cross-piece.
Figure 4:
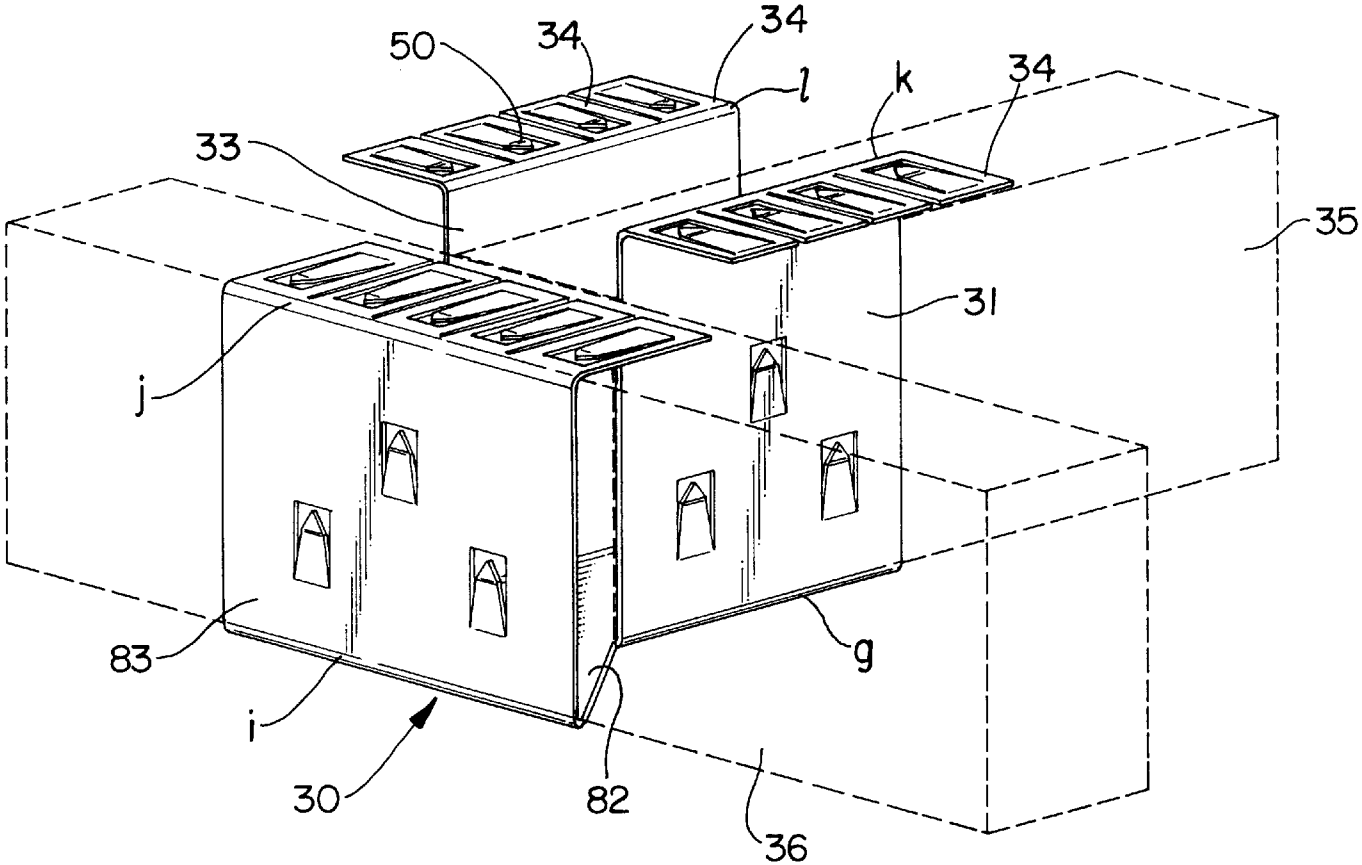
FIG. 4 shows a perspective view of the embodiment of the bracket shown in FIG. 3 in conformation for operational use. The support member and crosspiece are shown in phantom.
Figure 4A:
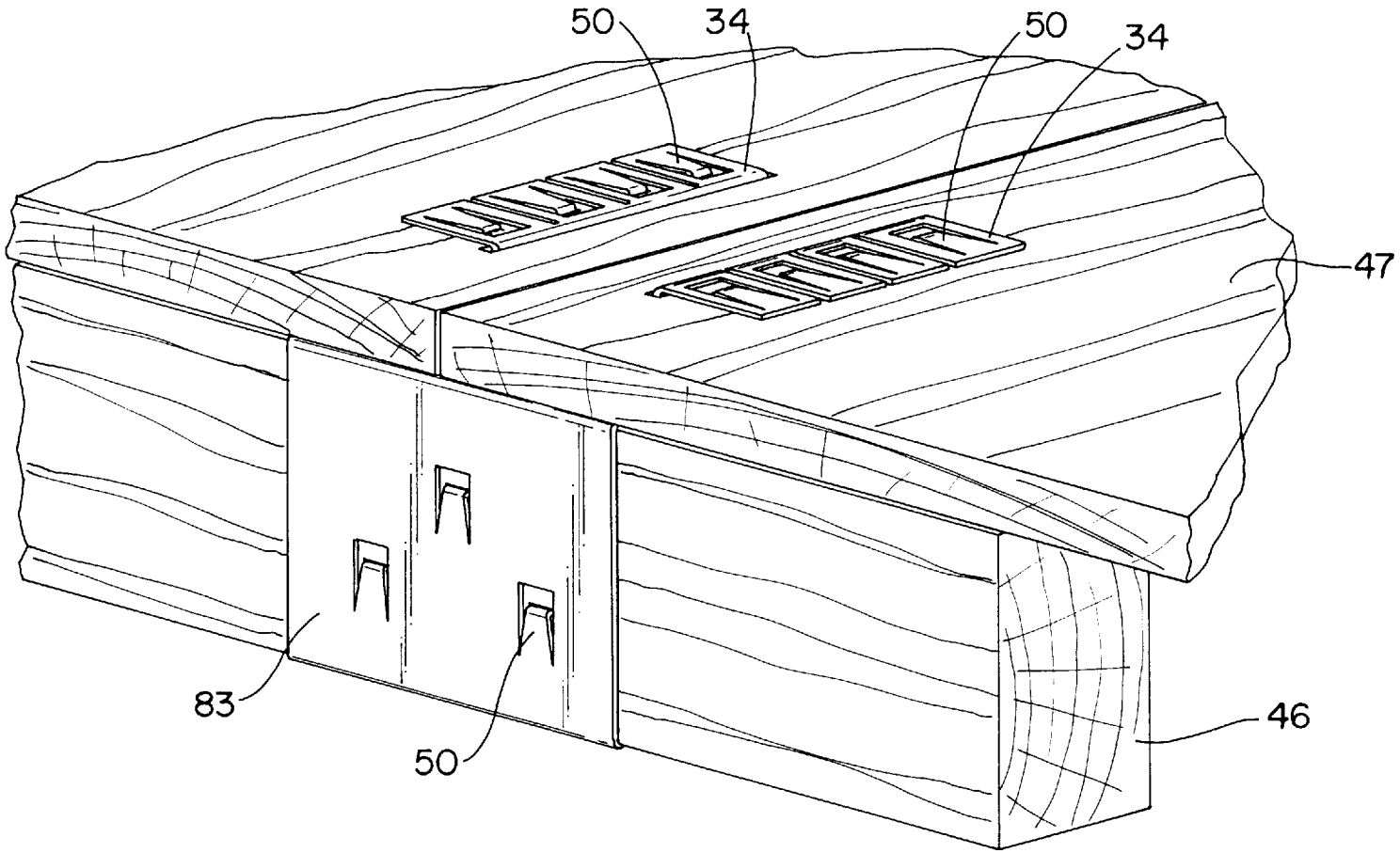
FIG. 4A shows a perspective view of the embodiment of the bracket shown in FIG. 3, in operational use with a roof panel and support.

A further embodiment of the subject invention is shown in the flat configuration in FIG. 3 and in a configuration for operational use in FIGS. 4 and 4A. This embodiment is useful for securing a roof panel 47 to its support member 45 at a juncture wherein the support rafter or stud 45 abuts a cross-piece 46 (shown in FIGS. 4 and 4A), e.g., a subfacia support, and is hereinafter termed the "subfacia connector embodiment." As can be seen in FIG. 3, the subfacia connector bracket 30 comprises a pair of main body plates 31 and 33, wherein the main body plates 31 and 33 are connected by a connecting plate 32 which is approximately equal in length to the shortest side of the support 35 (FIG. 4). Securing plates 34 are connected at one edge of the main body plates 31 and 33 to extend past the outer face of a roof or wall panel overlying the support member. As shown in FIG. 3, a plurality of securing plates 34 can be included. These securing plates 34 can be folded over the outer face of a roof or wall panel 47 in a manner to secure the panel such that it bears on the support 45 and crosspiece 46. The roof or wall panel can be notched to receive the securing plate 34 (FIG. 4A). Preferably, the main body plates 31 and 33, connecting plate 32, and securing plates 34 can include at least one anchoring means 50 as described for fastening the bracket to the support and roof panel.

In addition, as illustrated in the flat configuration in FIG. 3 and in operational use in FIGS. 4 and 4A, this subfacia connector embodiment of the subject invention includes an extension plate 81 which extends forward from the main body connecting plate 32 to enwrap or engage the crosspiece support, e.g., subfacia board, on at least two sides. In a preferred embodiment, the forward extension plate 81 includes bend line i which divides said forward extension plate into a subfacia extension plate 82 and subfacia face plate 83. Preferably, the subfacia face plate 83 is of a size such that it extends substantially the width of a subfacia support 45. In use, as shown in FIGS. 4 and 4A, the subfacia connector bracket 30 is positioned so that the subfacia extension plate 82 engages the bottom edge of the subfacia board 46. This embodiment shows a subfacia extension plate 82 having a trapezoidal shape wherein said subfacia extension plate 82 is equal in width to the connecting plate 32 (shown in FIG. 3) at its juncture therewith, and is of a broader width, substantially equal to the width of the subfacia face plate 83, at its juncture with the subfacia face plate 83. A bend is formed at bend line i such that the subfacia face plate 83 is bent to contact the front or outer face of the subfacia board. Main body plates 31 and 33 are bent at bend lines g and h, respectively, so that main body plates 31 and 32 contact the joist 45. Securing plates 34 are bent over the top of either the subfacia board 46 or the roof panel 47, using bend lines j, k, and l. The subfacia connector bracket 30 can be affixed to the subfacia board 46 and joist 45 by means of the anchoring means 50, with or without additional conventional attachment or fastening means such as nails, screws, staples, bolts, or the like. Pre-formed apertures 21 can be placed at various locations on the bracket for receiving said attachment means.

Figure 5:
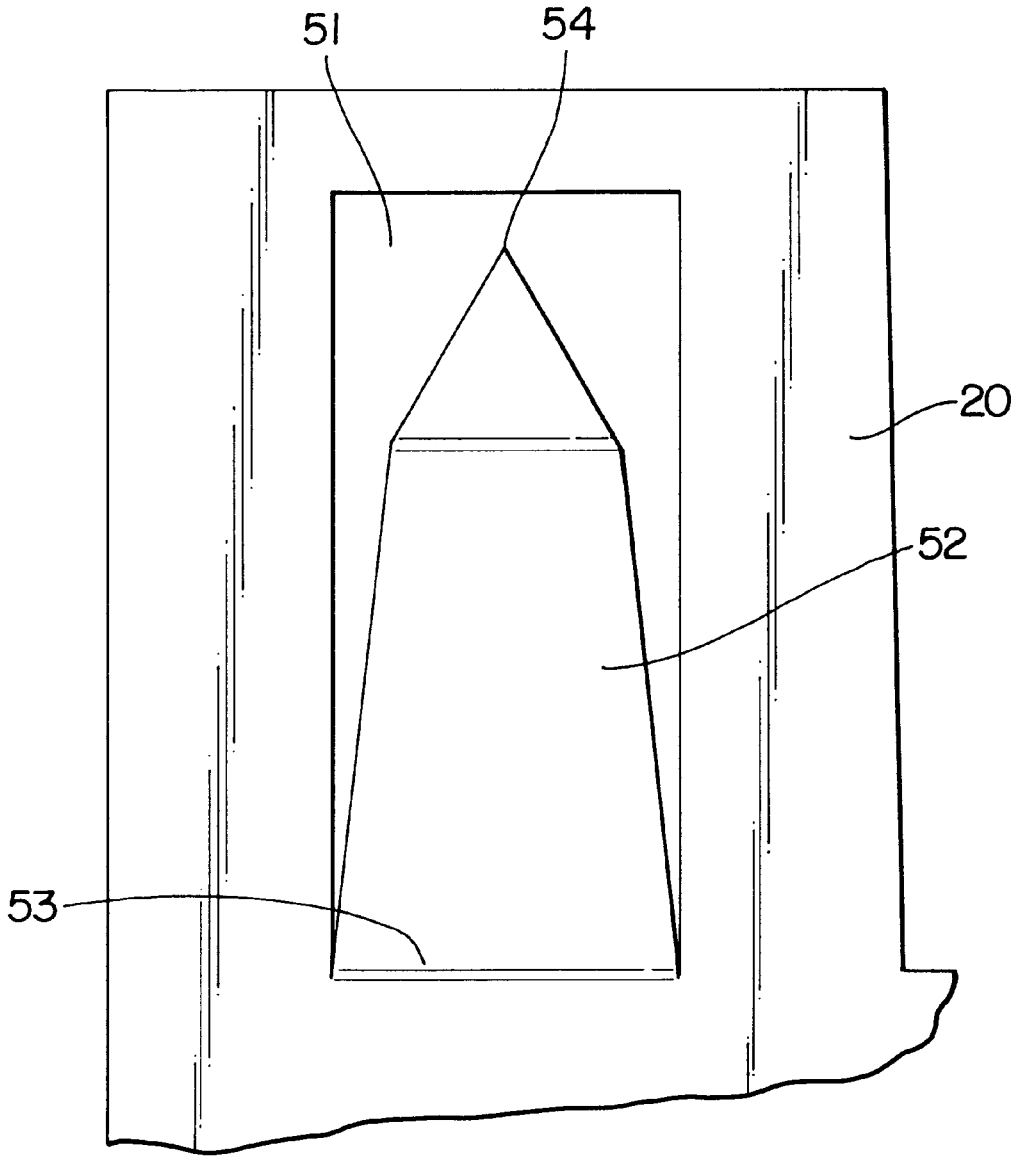
FIG. 5 shows an enlarged plan view of an anchor means according to the subject invention.

Preferably, main body plates 11 and 13 of the embodiment shown in FIGS. 1–2A; main body plates 31, 33, and subfacia face plate 83 of the embodiment shown in FIGS. 3–4; band 111, stud plates 115 of the embodiment shown in FIGS. 7A–9, and the securing plates 20 comprise anchors 50, which can be used to secure the bracket to the support member or to the outer face of the roof or wall panels. As shown in FIG. 5, the anchors 50 are formed as a generally elongate cut-out having a vertex that forms a point which is preferably angled sharply enough to be easily hammered into an underlying support or roof or wall panel when the sharply angled vertex is bent toward said support or roof or wall panel. The cut-out allows the body of the anchors to be bent outward, away from the support or roof or wall panel, such that the pointed end can be directed toward the support or the wall or roof panel and hammered thereinto. This anchor system can advantageously eliminate the need for nails or other extraneous securing means to secure the bracket in place during use.

The anchoring means 50 as described for the subject invention is specifically illustrated in an enlarged view in FIG. 5, showing the cut-out area 51 in the securing plate 20 in which the anchor is formed, a substantially elongate fastener 52 formed by removal of the cut-out area, wherein the fastener 52 comprises a base 53 and a pointed free end or vertex 54. The vertex 54 is formed at an angle which is acute or sharp enough to form a point which can be directed toward and driven, e.g., hammered, into an underlying support or panel.

Figure 6C:
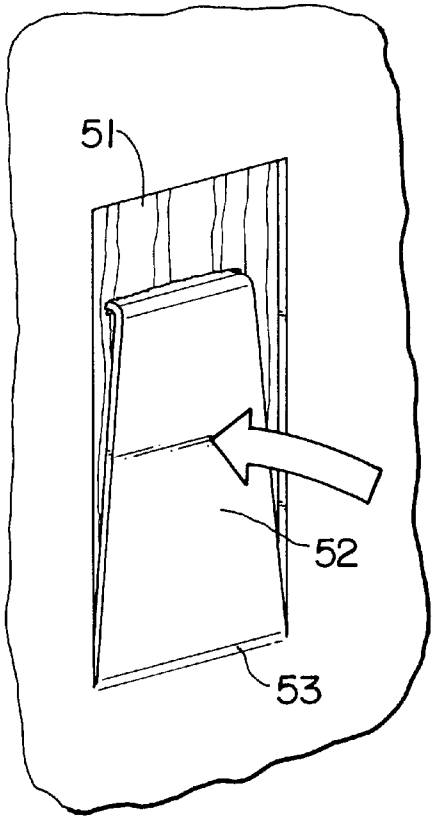
FIGS. 6A, 6B, and 6C show the anchoring means of the subject invention in stepwise operational use.
Figure 6B:
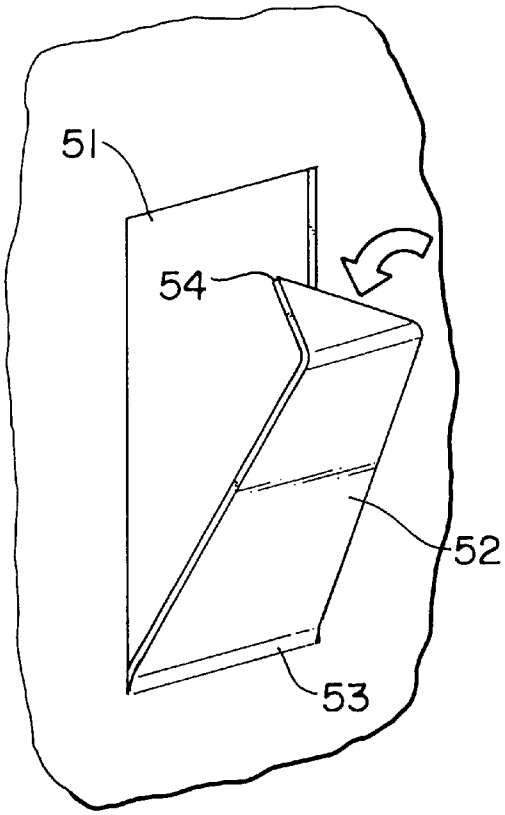
Figure 6A:
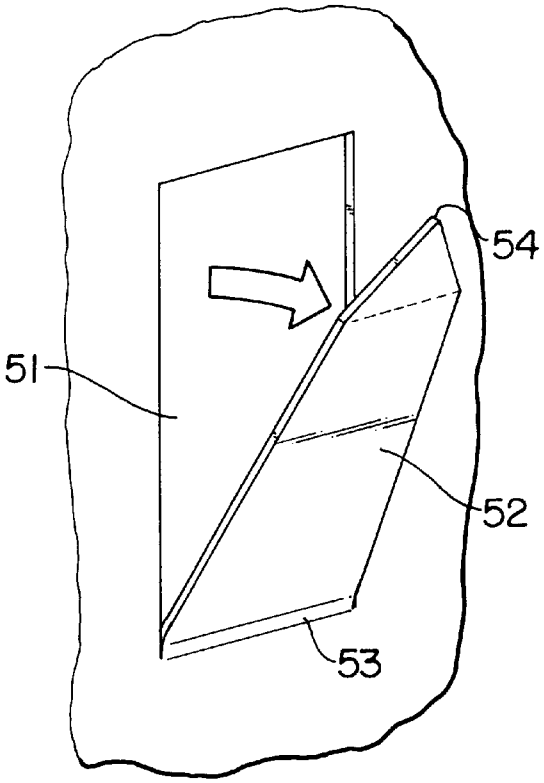
Figure 7A:
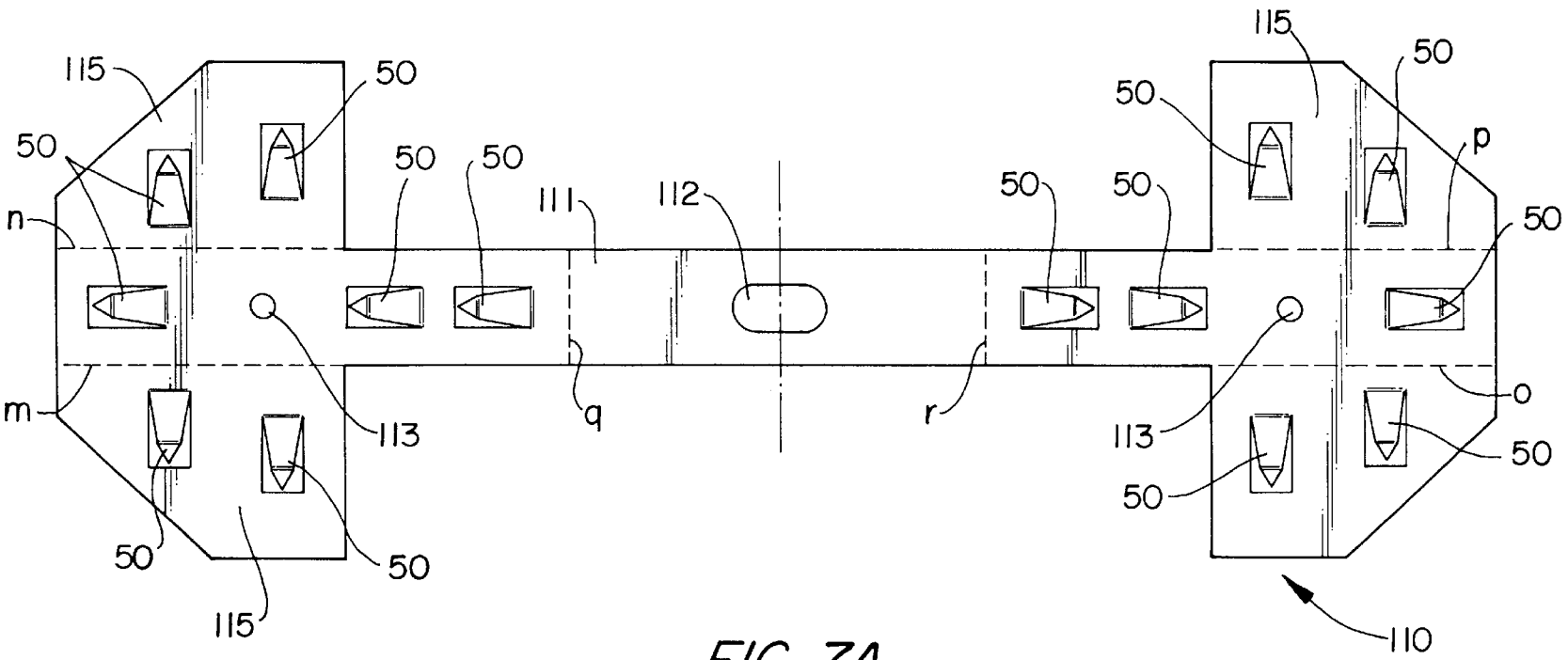
FIG. 7A shows a plan view of an embodiment of a stud connector, in flat configuration, according to the subject invention.
Figure 7B:
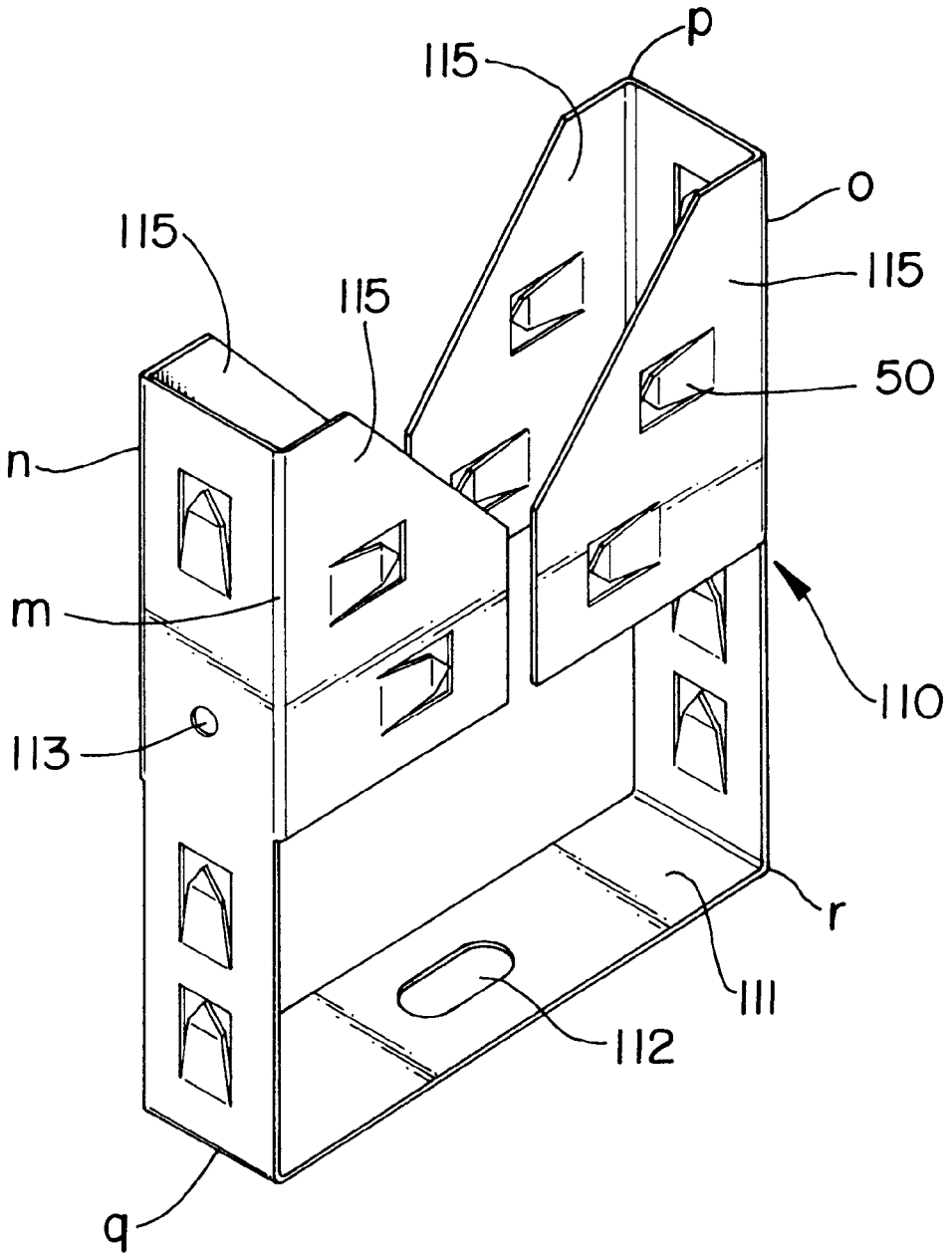
FIG. 7B shows, in a bended configuration, a perspective view of the embodiment of the stud connector illustrated in FIG. 7A.

The anchor means 50 is shown in operational use in FIGS. 6A–6C. FIG. 6A shows the anchor means 50 bent outwardly (arrow) at its base 53. The vertex 54 is then bent relative to the rest of the fastener 52 toward (arrow) the roof or wall panel or other underlying support member (FIG. 6B). The vertex 54 is then driven, e.g., hammered, into the roof or wall panel or underlying support member (arrow) such that it is secured thereto, and the fastener 52 is substantially flattened thereagainst (FIG. 6C).

The system of the subject invention further comprises a stud connector for connecting a stud perpendicularly to its support beam. The stud connector is shown in its flat configuration in FIG. 7A and in its operational configuration in FIG. 7B. The stud connector 110 comprises a band 111, preferably rectangular, dimensioned such that its length is substantially greater than its width.

Coextensive with and at each end of the band 111 are stud plates 115 which engage the stud. Stud plates 115 adjoin the band 111 portion of the stud connector along bend lines m, n, o, and p. Bend lines q and r are also provided for allowing the band 111 to be enwrapped around three sides of the support beam and along the edges of the stud. Anchor means 50, as described herein, can also be included in the band 111 portion or the stud plate 115 portion of the subject connector 110.

The band 111 can include apertures 112 and 113 for receiving attachment means, e.g., nails, screws, bolts, tacks, brads, rivets, and the like, placed at various locations along the length of the band 111. The band can include a pre-formed aperture 112 at the center of the band 111 for receiving an attachment means, e.g., a bolt, used to attach the support beam to the foundation of a building. Pre-formed apertures 113, generally placed at a distance remote from the central aperture, can be included in various places on the band or stud plates of the subject stud connector to receive attachment means, e.g. nails, used for affixing the stud connector 111 to a stud.

Figure 8:
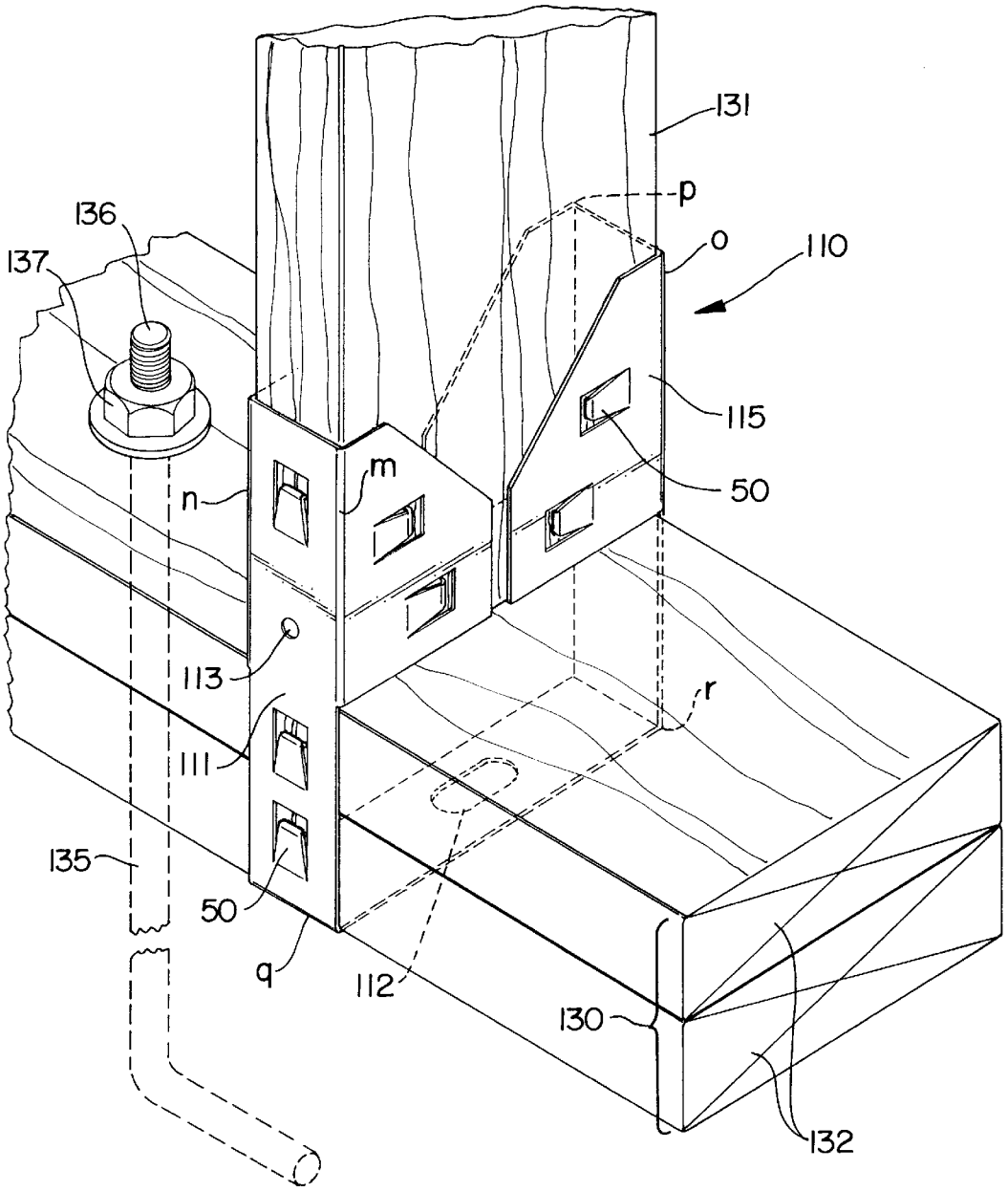
FIG. 8 shows a perspective view of an embodiment of the stud connector of the subject invention in operational use.

Typically, the stud connector is used with a two-by-four inch or two-by-six inch stud supported by two boards of the same size as the stud. The two stud supports are typically placed face-to-face to form a single support beam which is therefore either four-by-four inches or four-by-six inches in dimension (FIG. 8). The dimensions of the subject stud connector generally correspond to the stud and support beams with which it is used. Therefore, the band 111 is typically about two inches wide. The length of the stud connector is typically about twenty inches long in order to enwrap three sides of the support beam and extend along the edges of the stud. Other dimensions for the stud connector could be utilized according to the desires of the user.

In use, as illustrated for a stud in FIG. 8, the stud connector 110, in flat configuration, is centered on a side of the support beam 130 opposite the side of the beam 130 contacting the stud 131. As shown in FIG. 8, the support beam 130 is forward by placing the two boards 132 together along their axial length. The stud connector 110 is then bent at bend lines q and r so that the band 111 contacts three sides of the support beam 130, and extends along opposite edges of a stud 131 positioned perpendicular to the support beam 130. Stud plates 115 can then be bent along bend lines m, n, o, and p to contact the stud 131. Anchor means 50 can then be driven into the stud 131 and stud support beam 130 as described and shown (FIGS. 6A, 6B, and 6C). Additional attachment means can be used to secure the stud connector 110 to the stud 131 or stud support beam 130. For example, in a preferred embodiment, nails are driven into the stud 131 through pre-formed apertures 113 which serve as pre-drilled nail holes. The stud support beam 130 can also be secured to a foundation of a building (not shown) by a foundation securing means 135, e.g., a threaded bolt 136 and nut 137 (FIG. 8).

Figure 9:
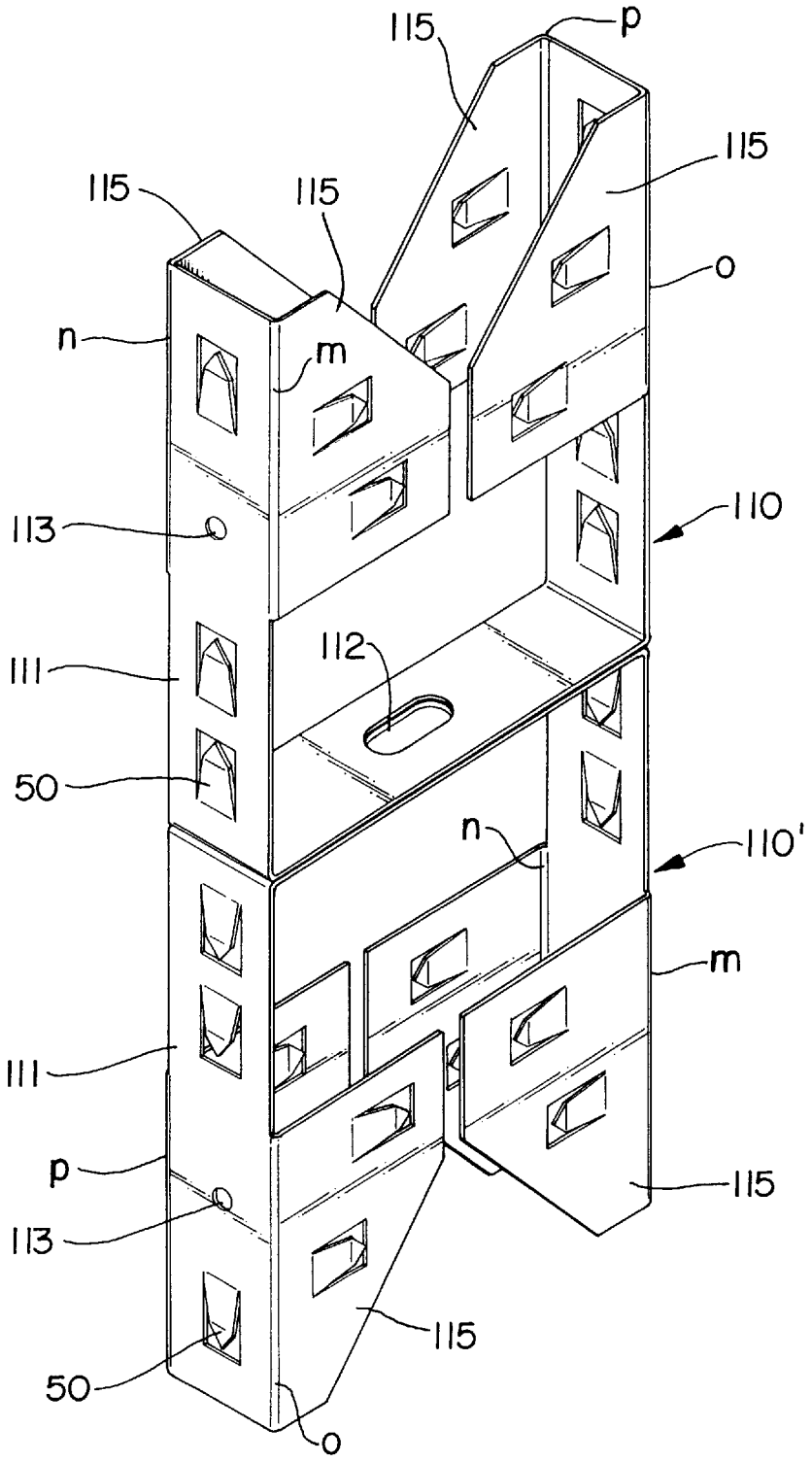
FIG. 9 shows, in perspective view, the placement of a pair of stud connectors according to the subject invention in a configuration to connect studs above and below stud support beams.

In addition, the subject stud connector 110 can be used in combination with a second stud connector 110', as shown in FIG. 9, to connect studs above and below a stud support beam (not shown), for example, in a multiple-story building. All other aspects of this configuration are as described herein for the single stud connector.

It should be understood that the examples and embodiments described herein are for illustrative purposes only and that various modifications or changes in light thereof will be suggested to persons skilled in the art and are to be included within the spirit and purview of this application and the scope of the appended claims.

What is claimed is:

1. A support system for a building, comprising:

a panel;

a support member supporting said panel, said support member having a centerline; and, a bracket comprising:

a main body having plates, said plates engaging at least three sides of said support member, said plates including:

a first main body plate, a second main body plate, said first and second main body plates respectively engaging opposite sides of said support member, a connecting plate disposed between and connecting said first and second main body plates, a first gusset plate extending from said first main body plate, a second gusset plate extending from said second main body plates, said first and second gusset plates extending in opposite directions from the centerline and along a common plane, and, a plurality of securing plates engaging an outer face of said panel, each of said first and second gusset plates including at least one of said plurality of securing plates.

2. A support system for a building, comprising:

a panel;

a support member support said panel;

a cross member supporting said panel, said cross member connected to and oriented perpendicular to an end of said support member; and, a bracket comprising:

a main body having plates engaging at least three sides of said support member, said plates including:

a first main body plate, a second main body plate, said first and second main body plates respectively engaging opposite sides of said support member, a connecting plate disposed between and connecting said first and second main body plates, a forward-extending plate engaging at least three sides of said cross member, said forward-extending plate connected to said main body, and a plurality of securing plates engaging an outer face of said panel, at least one of said plurality of securing plates extending from each of said first and second main body plates.

3. The bracket of claim 2, wherein said forward-extending plate comprises an extension panel engaging an underside of the cross-member, said extension panel being substantially trapezoid-shaped.

4. The bracket of claim 1, further comprising anchoring means for affixing said bracket to the support member and the wall panel.

5. A support system for a building, comprising:

a stud;

a support beam oriented perpendicular to said stud, said stud engaging a top face of said support beam; and, a stud connector comprising:

a band engaging at least three faces of said support beam and having a first distal end and a second distal end, two faces of said at least three faces being parallel and non-planar with respect to each other and a third face of said at least three faces opposing said top face, said band and said stud surrounding said support beam, a first stud plate engaging at least three sides of said stud, said first stud plate attached to said first distal end, and a second stud plate engaging at least three sides of said stud, said second stud plate attached to said second distal end.

6. The stud connector of claim 5, further comprising anchoring means for affixing said stud connector to the stud or support beam.

7. The bracket of claim 2, further comprising anchoring means for affixing said bracket to the support member, the crosspiece, member, and the wall panel.

* * * * *